US005109567A

United States Patent [19]

Harrison

[11] Patent Number: 5,109,567

[45] Date of Patent: May 5, 1992

[54] DUCT AIR SWEEPER

[75] Inventor: Richard R. Harrison, Houston, Tex.

[73] Assignee: Steamatic, Inc., Grand Prairie, Tex.

[21] Appl. No.: 692,568

[22] Filed: Apr. 29, 1991

[51] Int. Cl.[5] ..... A47L 5/38; B08B 1/04

[52] U.S. Cl. ..... 15/345; 15/395; 15/406

[58] Field of Search ..... 15/345, 395, 346, 406

[56] References Cited

U.S. PATENT DOCUMENTS

| | | | |
|---|---|---|---|
| 1,869,730 | 8/1932 | Antle | 15/395 X |
| 3,946,459 | 3/1976 | Armstrong | 15/395 X |
| 4,792,363 | 12/1988 | Franklin et al. | 15/395 X |
| 4,800,616 | 1/1989 | Wade | 15/395 X |
| 4,984,329 | 1/1991 | Wade | 15/395 X |
| 5,020,188 | 6/1991 | Walton | 15/345 X |

FOREIGN PATENT DOCUMENTS

| | | | |
|---|---|---|---|
| 2064410 | 7/1971 | Fed. Rep. of Germany | 15/387 |

*Primary Examiner*—Chris K. Moore
*Attorney, Agent, or Firm*—Arthur F. Zobal

[57] ABSTRACT

A main hose has one end which supports a hub and outward extending tubular members for rotation. Said one end of the main hose has inlet openings and the other end is coupled to a vacuum blower. A second smaller diameter hose extends into the main hose and has one end connected to the hub and the other end connected to a compressor. The compressor is operated to inject air through the second hose and through the rotatable tubular members for rotating the hub and the tubular members and for injecting air outward through the tubular member onto the walls of the duct to be cleaned. The vacuum blower is operated to form reduced air pressure in the main hose to withdraw the loosened material by way of the inlet openings at said one end and through the main hose by way of the vacuum blower.

8 Claims, 3 Drawing Sheets

DUCT AIR SWEEPER

BACKGROUND OF THE INVENTION

1. Field of the Invention

The invention relates to a cleaning apparatus for cleaning air ducts in houses or buildings.

2. Description of the Prior Art

U.S. Pat. No. 4,984,329 discloses a duct cleaning apparatus having a brush for cleaning the ducts in houses, buildings, etc. This cleaning apparatus is effective, however, new ducts on the market now are made out of pressed fiberglass covered with aluminum foil. The use of a brush in such a duct may damage the inside walls of the duct and hence a new type of cleaning mechanism is desired to prevent damage to the walls of this type of duct.

SUMMARY OF THE INVENTION

It is an object of the invention to provide an apparatus for cleaning ducts in houses or buildings which will not damage the walls of the new types of ducts formed of pressed fiberglass and which is effective and simple to operate.

It is an object of the invention to provide a cleaning apparatus in which air under pressure is applied to the walls of the duct to be cleaned and then the loosened material is withdrawn by way of a main flexible hose.

In one aspect, the hose has an air injection means at one end for injecting air under pressure onto the walls of a duct to be cleaned and inlet means through which the loosened material is withdrawn by way of the hose with reduced air pressure.

In a further aspect, the apparatus of the invention comprises a first flexible hose having a first end adapted to fit into a duct or the like for cleaning the inside walls thereof. Support means is coupled to said first end of said main hose. A hub is supported for rotation by said support means. The hub has an inlet opening and a plurality of outlet openings. A second flexible hose is coupled to said inlet opening of said hub means for receiving air under pressure for injecting air under pressure through said outlet openings for rotating said hub means and for applying air under pressure onto the inside wall of the duct to be cleaned. In addition, inlet means is located near said first end of said first hose through which loosened material can be withdrawn into said first hose by reduced pressure therein.

An air compressor and a vacuum means are provided for applying air under pressure to said second hose and for reducing the pressure in said first hose respectively.

In the embodiment disclosed, a plurality of tube means are coupled to said plurality of outlet openings of said hub means respectively and extend outward from said hub means in directions for causing said hub means to rotate when air under pressure flows through said tube means.

In addition spacing means is coupled around the exterior of said first hose means near said first end for spacing said first end of said first hose and said tube means from the inside wall of the duct.

BRIEF DESCRIPTION OF THE INVENTION

DESCRIPTION OF THE PREFERRED EMBODIMENTS

Figures 1, 4, 5, 9, 10:
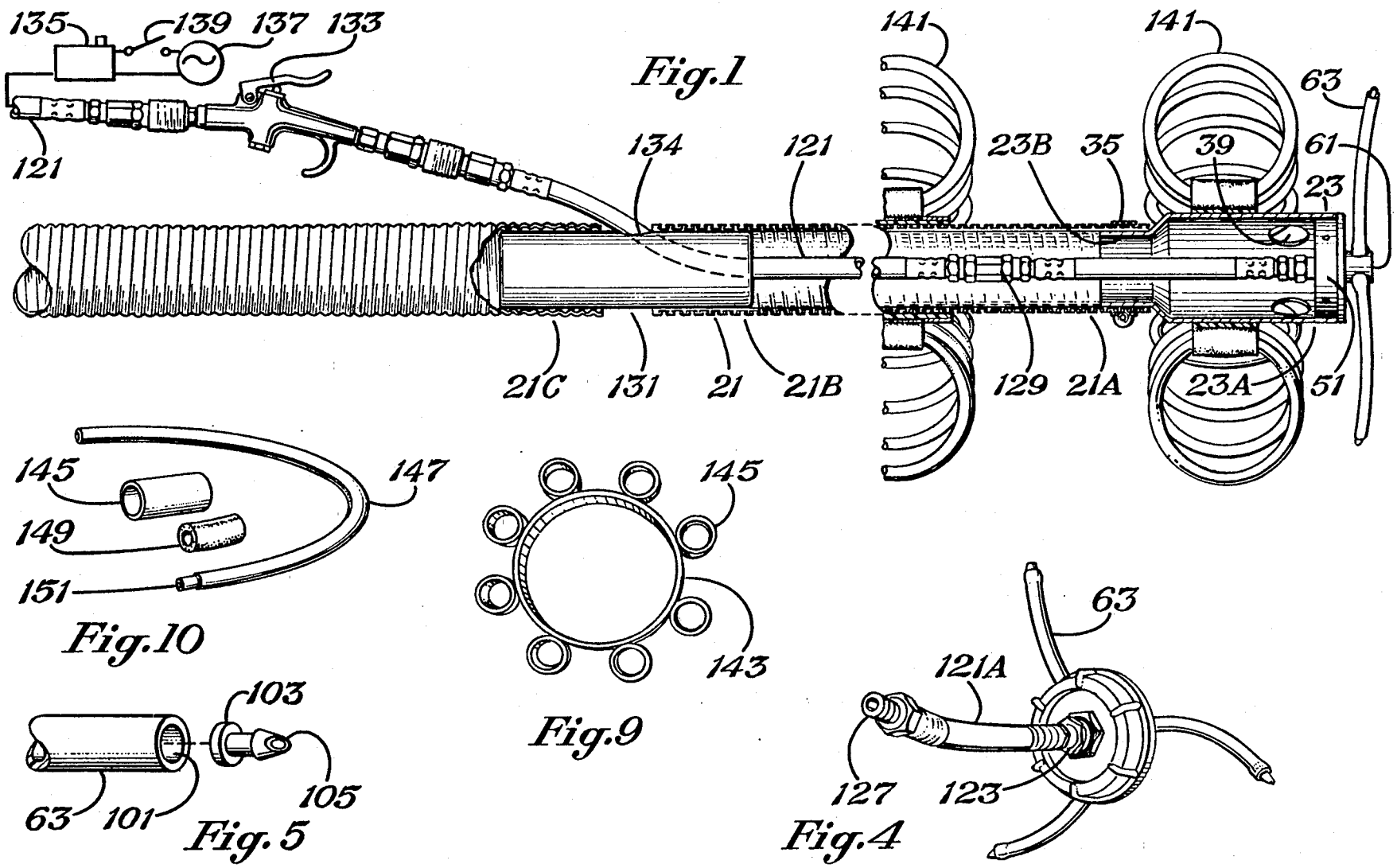
FIG. 1 is a partial cross-sectional view of the apparatus of the invention.
FIG. 4 is an isometric view of the rear end of the end cap of the main hose and the rotating tubular members.
FIG. 5 illustrates one of the exterior outer ends of the three tubular members of FIG. 4.
FIG. 9 is an end view of one of the supports for supporting a group of spacer means.
FIG. 10 illustrates in detail the components of one of the spacer means.
Figure 3:
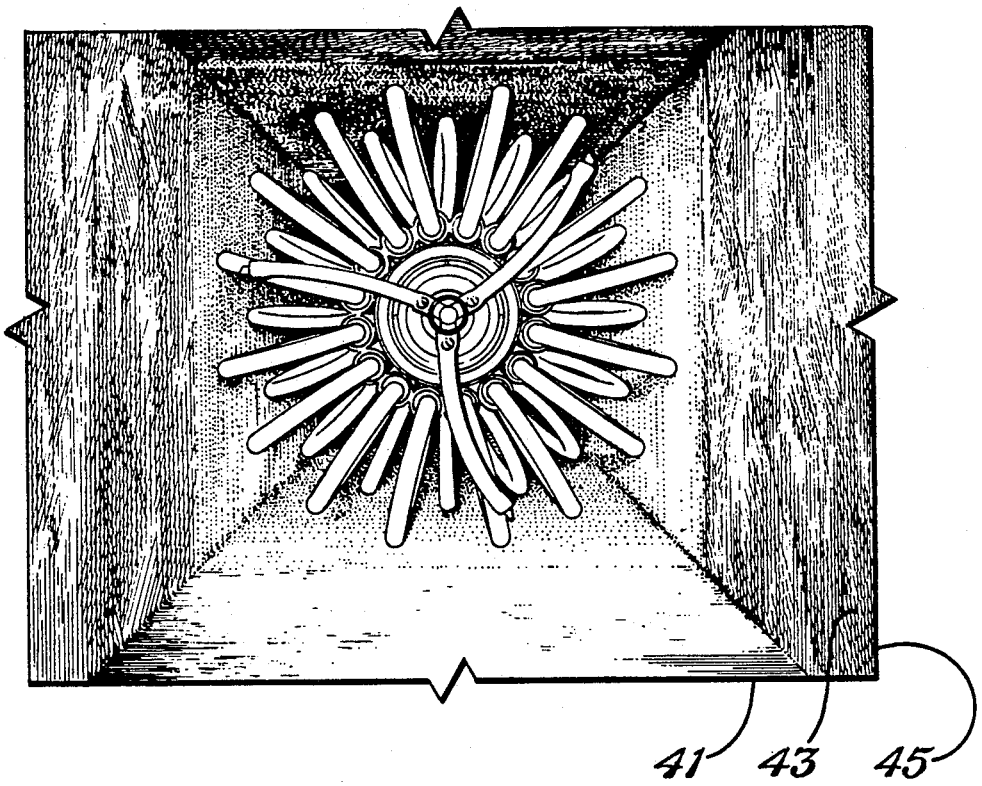
FIG. 3 illustrates a front view of the apparatus of the invention located in a air duct.
Figure 2:
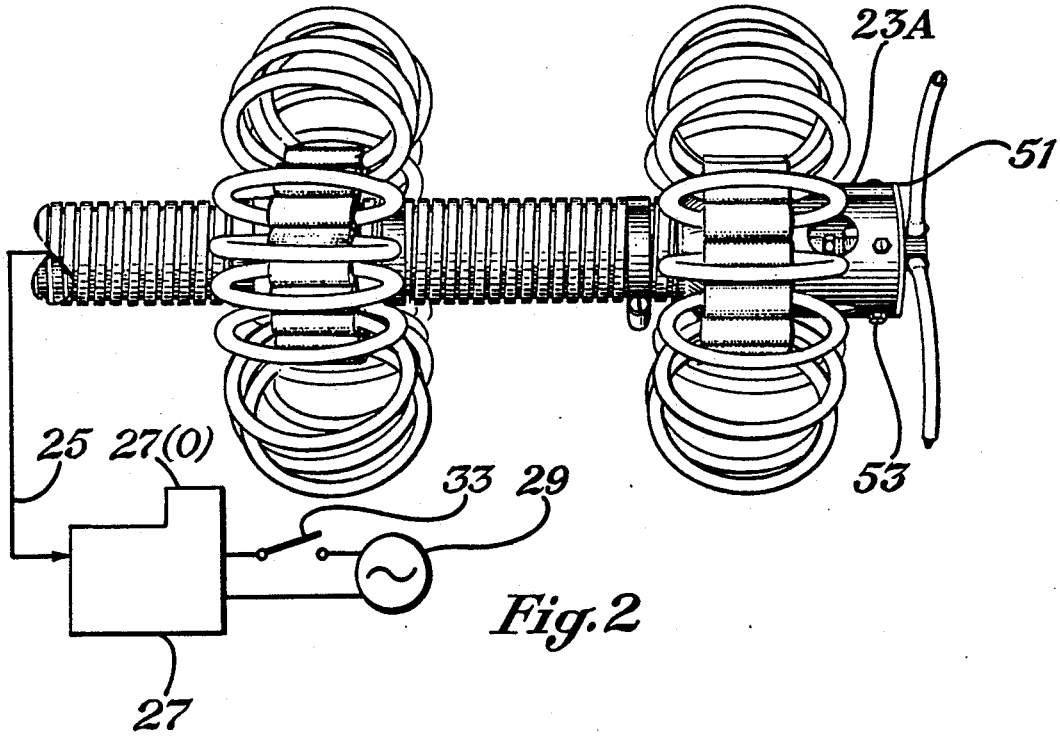
FIG. 2 illustrates a centering or spacing means of the apparatus of the invention for spacing the main hose from the wall of the duct to be cleaned.
Figure 7:
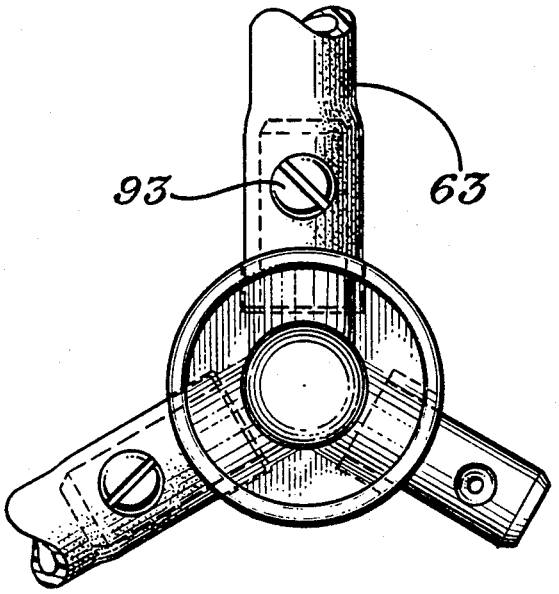
FIG. 7 is a front view of the hub of FIG. 6.
Figure 8:
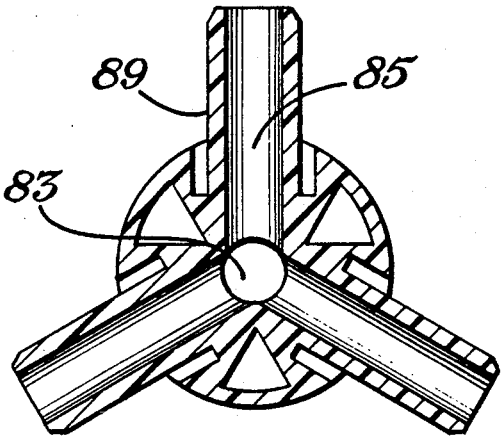
FIG. 8 is an cross-sectional view of FIG. 7 taken along the lines 8—8 thereof.

Referring now to the drawings, the apparatus of the invention comprises a main flexible hose 21 having an end portion 23 adapted to be located inside of an air duct to be cleaned and an end 25 coupled to a vacuum blower 27 operated by an AC source 29 when a switch 33 is closed. The hose 21 is formed of conventional corrugated plastic material which can be easily bent for turning corners in a duct to be cleaned which is illustrated in FIG. 3 as an air duct 41. This duct is of the newer design which is commercially available and comprises compacted fiberglass walls 43 enclosed by a thin aluminum cover 45. The duct 41 is shown in cross-section to be rectangular, however it could be round. Ducts of this type are being commercially manufactured today since they are inexpensive to manufacture and easy to install.

The end portion 23 of the hose 21 comprises an aluminum cylindrical member having an enlarged portion 23A and a smaller diameter rear portion 23B which fits into the end 21A of the hose 21 and is secured therein by way of a clamp 35. The aluminum member 23 has a central opening 37 formed therethrough along the axis. Side openings 39 are formed through the wall of the member 23 near its forward end.

Figure 6:
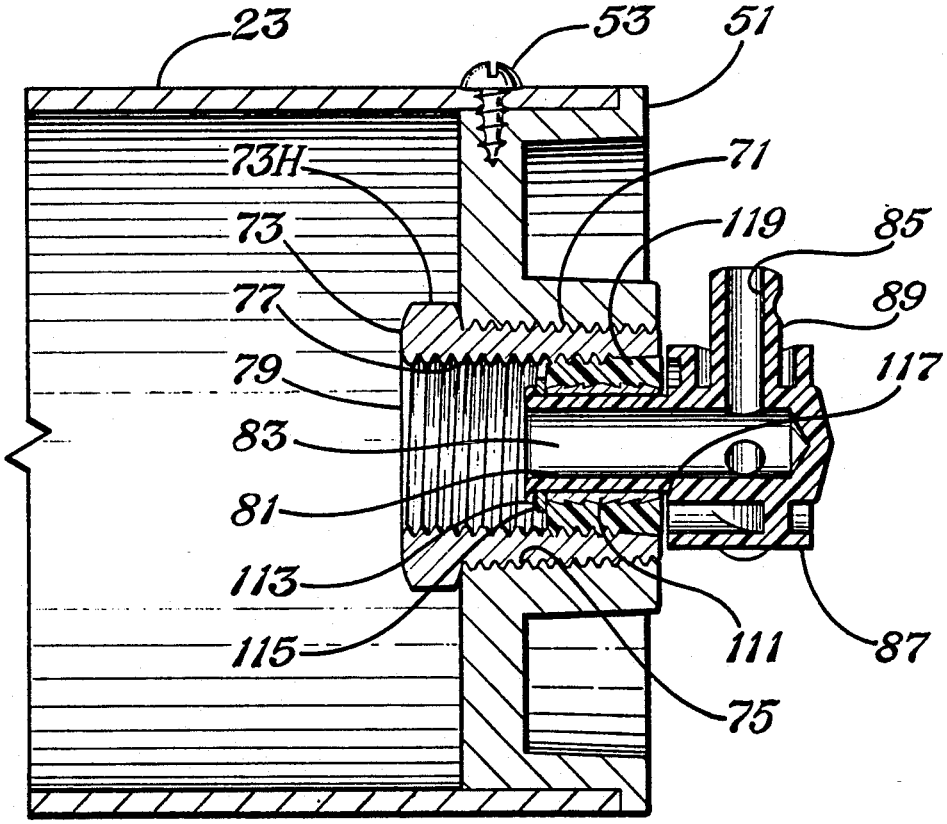
FIG. 6 is an enlarged cross-sectional view of the hub supported by the end cap for rotating the three tubular members.

An end cap 51 formed of a suitable plastic material is located partially inside of the forward end of the member 23 and secured thereto by screws 53. The cap 51 supports a hub 61 and three tubular members 63 for rotation. As shown in FIG. 6, the end cap 51 has a threaded opening 71 formed therethrough. A metal connector 73 having exterior threads 75 and interior threads 77 with an opening 79 formed therethrough is screwed into the interior threads 71 of the cap 51. The hex-shaped end 73H of connector 73 is located on the inside of the member 23 when the end cap 51 fitted in place. The hub 61 is a commercially available member used for sprinklers. It is available commercially from Melnor Corporation. It is formed of plastic and comprises a shaft 81 having an inlet opening 83 which leads to three angularly spaced apart openings 85 which extends radially outward from its annular housing 87. The openings 85 extend to three tubular members 89 which extend radially outward from the housing 87. The openings 85 are in fluid communication with the inlet opening 83. The center lines of adjacent openings 85 form an angle of 120°. The three tubular members 63 are coupled to the three tubular ends 89 by way of screws 93. The three tubular members 63 extend outward and are curved such that when air under pressure is injected into the inlet opening 83 it flows by way of opening 85 into the tubular members 63 and out of their outlet opening to cause the hub 61 with the three tubular members 63 to rotate. The outlet opening of each of the tubular members 63 comprises an outlet opening 101 having a tubular insert 103 located therein and having outlet openings 105 formed at an angle relative to the axis thereof. The openings 105 are located to enhance rotation of the tubular members 63 and the hub 61. The hub 61 is supported for rotation by way of a metal bearing 111 which rotatably fits around the rear shaft 81 and is held in place between shoulder 113 and washer 115 and shoulder 117. A plastic bushing 119 is force fitted between the metal bearing 111 and the inside threads 75 of the connector 73 to hold the bearing 111 stationary relative to the connector 73 and the cap 51 and to allow the shaft 81, housing 87 and tubular members 89 to rotate relative to the connector 73 and the cap 51.

A second hose 121 has a coupling member 123 screwed into the connector 73. The coupling member 123 is connected to a flexible hose portion 121A which in turn is connected to a male member 127 of a quick disconnect unit which includes a female member 129 connected to the hose 121. The front portion of the hose 121 is located within the main hose 21. The hose 121 extends through a plastic connecting member 131 which connects main hose portions 21B and 21C together. The connecting portion 131 has an aperture 134 formed therethrough through which the hose 121 exits to a exterior valve 133. The other end of the hose 121 is connected to a air compressor 135 which is electrically operated by AC power 137 by a closing of a switch 139.

Also connected to the exterior of the main hose 21 near its front end are two spacing members 141. The spacing members 141 are identical and each is formed by an encircling ring 143 secured around the circumference of the main hose 21 and a plurality of small tubular members 145 connected to the exterior of the ring 143. Inserted within the tubular members 145 are a plurality of flexible hoses 147 such that the hoses 147 form a plurality of rings extending around the main hose 21 to space the main hose 21 from the inside walls of the duct and also for spacing the rotating tubes 63 from the inside walls of the duct. Each of the hoses 147 is held in place within its ring 145 by a smaller diameter tubular insert 149 and a smaller diameter end 151. The tubular insert 149 is inserted into the ring 145 and the two ends of the hose 147 are inserted within the tubular member 149 and held in place by force fitting the end 151 into the other end of the hose 147. The planes of the rings formed by members 147 extend generally radially outward from the hose 21.

In operation, the hose 21 with its end 23 in a forward position is inserted into the air duct 45 to a desired inward position. The hose 21 then is pulled outward while the compressor 135 is operated and the valve 133 is opened and while the vacuum blower 27 is operated. This causes air under pressure to be injected through the hose 21 through the hub 61 and through the outlet openings of the tubular members 63 to cause the tubular members 63 and the hub to rotate and to cause the air under pressure to be injected through the small diameter outlet openings 105 which is applied to the inside walls of the duct to blow dust and other material therefrom which is then withdrawn by way of the suction inside of the main hose 21. Withdrawal of the loosened material into the main hose 21 is by way of the inlet openings 39, and then through the hose 21 and through the outlet 27(O) of the vacuum blower 27.

In one embodiment, the hose 21 has an inside diameter of two inches. It may have a length of about twenty-five feet from the opening 134 of member 131 to the cap 51. It is formed of flexible corrugated plastic. Members 141 may be spaced twelve inches apart. The flexible hose 121 has an inside diameter of one-fourth of an inch. It is formed of a suitable plastic or elastomer. The vacuum blower 27 may be operated at 300 cubic feet per minute. The compressor 135 may be operated at 90 pounds per square inch. The diameter of the circle formed by tubular members 63 is eleven inches. This apparatus is suitable for cleaning a rectangular air duct having inside dimensions of 12 inches X 12 inches, however, the apparatus of the invention may have different dimensions and specifications for cleaning different size air ducts.

I claim:

1. A cleaning apparatus comprising:

a flexible hose having an end adapted to be located in a duct or the like for cleaning the inside wall of the duct, air injection means located at said end of said hose for injecting air under pressure onto the wall of the duct to be cleaned, and inlet means located near said end of said hose through which loosened material can be withdrawn into said hose, by reduced pressure in said hose.

2. The cleaning apparatus of claim 1, comprising:

means coupled to said air injection means for applying air under pressure to said air injection means for injecting air under pressure onto the wall of the duct to be cleaned, and means coupled to said hose for reducing the pressure therein for withdrawing loosened material into said hose by way of said inlet means.

3. A cleaning apparatus, comprising:

a first flexible hose having a first end and a second end with said first end being adapted to fit into a duct or the like for cleaning the inside wall of the duct, a hub, support means coupled to said first end of said first hose for supporting said hub for rotation, said hub having an inlet opening and a plurality of outlet openings, a second flexible hose coupled to said inlet opening of said hub for receiving air under pressure for injecting air under pressure through said outlet openings of said hub for rotating said hub and for applying air under pressure onto the wall of the duct, and inlet means located near said first end of said first hose through which loosened material can be withdrawn into said first hose by reduced pressure therein.

4. The cleaning apparatus of claim 3, comprising:

means coupled to said second hose for applying air under pressure to said second hose for injecting air under pressure through said outlet openings of said hub for rotating said hub and for applying air under pressure onto the wall of the duct, and means coupled to said first hose for reducing the pressure therein for withdrawing loosened material into said first hose by way of said inlet means.

5. A cleaning apparatus, comprising:

a first flexible hose having a first end and a second end with said first end being adapted to fit into a duct or the like for cleaning the inside wall of the duct, a hub, support means coupled to said first end of said first hose for supporting said hub for rotation, said hub having an inlet opening on the inside of said first hose and a plurality of outlet openings located on the outside of said first hose in fluid communication with said inlet opening, a plurality of tubes coupled to said plurality of outlet openings respectively and extending outward from said hub, each of said tubes having an inner end coupled to one of said outlet openings and an outer end with an outlet opening with each of said tubes being in fluid communication with said inlet opening of said hub and said hub and said plurality of said tubes being capable of rotating together, a second flexible hose coupled to said inlet opening of said hub for receiving air under pressure for flow through said tubes by way of said outlet openings of said tubes for rotating said hub and said tubes and for applying air under pressure onto the inside wall of the duct, and inlet means formed through said main hose near said first end through which loosened material can be withdrawn into said first hose by reduced pressure in said first hose.

6. The cleaning apparatus of claim 5, comprising:

means coupled to said second hose for applying air under pressure to said second hose for flow through said tubes by way of said outlet openings of said tubes for rotating said hub and said tubes and for applying air under pressure onto the inside wall of the duct, and means coupled to said first hose for reducing the pressure therein for withdrawing loosened material into said first hose by way of said inlet means.

7. The apparatus of claim 6, comprising:

spacing means coupled around the exterior of said first hose near said first end for spacing said first end of said hose and said plurality of tubes from the inside wall of the duct.

8. The apparatus of claim 5, comprising:

spacing means coupled around the exterior of said first hose near said first end for spacing said first end of said hose and said plurality of tubes from the inside wall of the duct.

* * * * *